United States Patent [19]

Zobbi et al.

[11] Patent Number: 4,705,594

[45] Date of Patent: Nov. 10, 1987

[54] COMPOSITION AND METHOD FOR METAL SURFACE REFINEMENT

[75] Inventors: Robert G. Zobbi, Southbury; Mark Michaud, Bristol, both of Conn.

[73] Assignee: Rem Chemicals, Inc., Southington, Conn.

[21] Appl. No.: 929,790

[22] Filed: Nov. 20, 1986

[51] Int. Cl.[4] ..... C23F 1/00; B44C 1/22

[52] U.S. Cl. ..... 156/637; 156/664; 252/79.4; 148/6.14 A

[58] Field of Search ..... 156/637–639, 156/656, 664, 903; 252/79.1, 79.2, 79.4, 79.5; 134/3, 41, 32–34; 148/6.14 A, 6.15 R

[56] References Cited

U.S. PATENT DOCUMENTS 3,071,456 1/1963 Cheesman ..... 51/316

3,479,293 11/1969 Bellinger et al. ..... 252/79.4

4,491,500 1/1985 Michand et al. ..... 156/628

FOREIGN PATENT DOCUMENTS 1667781 2/1981 Japan .

*Primary Examiner*—William A. Powell

[57] ABSTRACT

A composition for use in the mass finishing of metal surfaces of objects, normally in a vibratory finishing process, utilizes the combination of oxalic acid, sodium nitrate, and hydrogen peroxide. The maximum concentration of the latter is limited to a value at which excessive dissolution of metal and pitting of the surface are avoided while, at the same time, cooperating with the nitrate to effect a substantial increase in the processing rate. Highly refined surfaces are achieved with the process in relatively short periods of time.

17 Claims, No Drawings

COMPOSITION AND METHOD FOR METAL SURFACE REFINEMENT

BACKGROUND OF THE INVENTION

A process for refining metal surfaces is described and claimed in Michaud et al U.S. Pat. No. 4,491,500, which process involves the development, physical removal and which continuous repair of a relatively soft oxide coating on the surface. High points are removed through mechanical action, preferably generated in but not limited to vibratory mass finishing apparatus, and very smooth and level surfaces are ultimately produced in relatively brief periods of time. Although the process described in the patent is most effective and satisfactory, it is self-evident that the realization of even higher production rates would constitute a valuable advance in the art.

Among the active ingredients specified in the Michaud et al patent, to provide exemplary formulations, are a phosphate salt or acid, or a mixture thereof with oxalic acid, sodium oxalate, or the like. The incorporation of a sulfate or chromate compound is disclosed, as is the use of metal phosphate activators or accelerators, and organic and inorganic oxidizers; if used, the latter is included in a minimum amount of 0.5 percent by weight of the total liquid substance. As a specific working example the patentees disclose a solution consisting of eight ounces, per gallon of water, of a mixture of 15 percent of sodium tripolyphosphate and 85 percent oxalic acid, to which is added 1.0 percent, based upon the total weight of the liquid substance, of a 35 percent aqueous solution of hydrogen peroxide (i.e., 0.103 gram mole per liter) containing a small amount of phosphoric acid stabilizer.

In such formulations, it is known that the incorporation of an oxidizing agent, e.g., hydrogen peroxide, produces a substantial increase in activity. This result is however accompanied by significant detrimental side-effects. In particular, as employed in the prior art the peroxide causes considerable dissolution of the metal, giving rise to very difficult problems of dimensional control and accuracy.

For example, oxalic acid/hydrogen peroxide solutions have been utilized widely for the surface refinement of workpieces prior to electroplating. Because of the tendency for the solution to dissolve metal from the non-contact surfaces, it has been necessary to form the workpiece with extra thicknesses of metal in such areas, so as to accommodate the dissolution and to endeavor to thereby produce the ultimate dimensional specifications. Such a process is obviously difficult to control and is, at least to that extent, inherently undesirable. (As used herein, the terms "non-contact surface" or "non-contact area" refer to those surfaces of the workpiece that are not exposed to substantial contact, during the surface refinement operation, by other workpieces or any mechanical finishing media used, such as are present within the open or box-end of a wrench.)

Furthermore, the peroxide concentrations heretofor employed have had a tendency to produce pitting of the metal surface, in turn creating a flawed appearance on the finished article. This gives rise to the need for further refinement of the surface, or necessitates the acceptance of a product of inferior surface quality.

Accordingly, it is an object of the present invention to provide a novel solution, and a novel composition for producing the same, which is highly effective for the refinement of metal surfaces utilizing a chemical/mechanical finishing technique.

It is a more specific object of the invention to provide such a solution and composition by which the surface refinement is achieved at an increased rate, while avoiding pitting of the surface or a substantial dimensional decrease on non-contact surfaces.

An additional specific object of the invention is to provide a solution and composition having the foregoing characteristics and advantages, which are of such chemical activity that the conversion coating produced is reformed continuously and at a high rate, and is of increased thickness, both features enabling utilization of mass finishing apparatus at high energy levels and thereby maximizing production rates.

A further object of the invention is to provide a novel process for the refinement of metal surfaces utilizing such solutions, which process achieves the desired surface and dimensional characteristics at high production rates, and is adapted to be carried out under ambient conditions.

SUMMARY OF THE DISCLOSURE

It has now been found that certain of the foregoing and related objects of the invention are readily attained by the provision of an aqueous solution comprising water, a water-soluble oxalate compound, a water-soluble nitrate compound, and a water-soluble peroxy compound. The solution contains a sufficient amount of the oxalate compound to provide about 0.125 to 0.65 gram mole per liter of the oxalate radical, a sufficient amount of the nitrate compound to provide at least about 0.004 gram mole per liter of the nitrate radical, and a sufficient amount of the peroxy compound to provide 0.001 to 0.05 gram mole per liter of the peroxy (—O—O—) group.

Generally, the nitrate compound will provide a maximum of about 0.2 gram mole per liter of the nitrate radical; the preferred solution will contain about 0.25 to 0.45 gram mole per liter of the oxalate radical, about 0.05 to 0.11 gram mole per liter of the nitrate radical, and about 0.01 to 0.03 gram mole per liter of the peroxy group. In many instances, best results will be achieved with a solution containing about 0.4 gram mole per liter of oxalate radical, about 0.1 gram mole per liter of the nitrate radical, and 0.02 gram mole per liter of the peroxy group. Normally, the oxalate compound will be oxalic acid, the nitrate compound will be sodium nitrate, and the peroxy compound will be hydrogen peroxide; the solution should have a pH of about 1.5 to 3.0, and it may include additional ingredients, such as an effective amount of a wetting agent.

Other objects of the invention are attained by the provision of a composition which, when added to water, will produce a solution as hereinabove described. Sodium perborate, sodium percarbonate, sodium persulfate, ammonium persulfate, potassium perborate and potassium persulfate may be used with oxalic acid and sodium nitrate to provide an exemplary dry, single-package composition.

Additional objects of the invention are attained by the provision of a process in which a mass of elements, including a quantity of objects with metal surfaces, is introduced into the container of a mass finishing unit. The elements are wetted with a solution of the composition described, and the mass is rapidly agitated while maintaining the surfaces in a wetted condition. The agitation produces relative movement and contact among the elements, and preferably continuous oxygenation of the solution, and is continued for a period of time sufficient to effect the desired refinement. Generally, the surfaces of the objects will have arithmetic average (AA) roughness values in excess of about 30 at the time of introduction, and will ultimately exhibit a roughness of about 6 AA or lower after a total agitation period of about four hours or less. Normally, the mass of elements will include a quantity of mechanical finishing media, and the solution will be used in an amount equal to about 15 to 25 percent of the volume of the mass finishing unit bowl.

Exemplary of the efficacy of the present invention are the following specific examples:

EXAMPLE ONE

Solutions having the compositions described below in Table One are prepared. The solid ingredients are expressed as percentages of their combined weights, and are used in a concentration of 45 grams of the mixture per liter of water; when employed (as indicated by an "X" in the table), hydrogen peroxide is used at a concentration of 0.035 gram mole of the compound per liter of solution, and is introduced by adding 0.3 percent (based upon the volume of the solution) of standard, 35 percent hydrogen peroxide reagent.

TABLE ONE

| | Solution Number | | | | | | | |
|---|---|---|---|---|---|---|---|---|
| Ingredient | 1 | 2 | 3 | 4 | 5 | 6 | 7 | 8 |
| Oxalic Acid | 99.5 | 99.5 | 79.5 | 79.5 | 79.5 | 79.5 | 59.5 | — |
| Tripoly-phosphate | — | — | 20 | 20 | — | — | 20 | — |
| Sodium Nitrate | — | — | — | — | 20 | 20 | 20 | — |
| Sodium Hydroxide | — | — | — | — | — | — | — | 99.5 |
| Sodium Lauryl Sulfonate | 0.5 | 0.5 | 0.5 | 0.5 | 0.5 | 0.5 | 0.5 | 0.5 |
| Hydrogen Peroxide | — | X | — | X | — | X | X | — |

The workpieces employed are the box-end portions cut from wrenches forged from 50B44 steel, heat treated to a Rockwell "C" hardness of 50–53 and then temper drawn in a salt bath to a Rockwell "C" value of 41–43. Ten such parts are loaded into a vibratory finishing unit, together with a sufficient amount of a fired porcelain media (of 1⅜ inch by ½ inch thick triangular form and containing 28 percent of 325 grit aluminum oxide) to substantially fill its 140 liter bowl, and the unit is operated at the 4 millimeter amplitude setting. Fresh solution is continuously metered into the bowl and drawn off, at a rate of about 23 liters per hour, and the temperature rises from ambient to about 35° Centigrade during the run. The weight loss ("Wt"—expressed as a percentage of the starting weight) and surface refinement, as functions of time (expressed in hours elapsed), are reported in Table Two below; the surface finish is expressed by the extremes of arithmetic average roughness (AA) values, as determined by a "P-5" Hommel Tester:

TABLE TWO

| Time: | Starting | | 1 | | 2 | | 3 | | 4 | |
|---|---|---|---|---|---|---|---|---|---|---|
| No. | Wt | AA | Wt | AA | Wt | AA | Wt | AA | Wt | AA |
| 1 | — | 110–160 | 0.214 | 40–60 | 0.458 | 20–35 | 0.635 | 15–20 | 0.833 | 8–12 |
| 2 | — | 110–170 | 0.232 | 40–60 | 0.456 | 18–30 | 0.687 | 10–16 | 0.920 | 6–9 |
| 3 | — | 110–160 | 0.132 | 55–90 | 0.297 | 28–42 | 0.442 | 16–24 | 0.580 | 10–14 |
| 4 | — | 120–180 | 0.240 | 38–56 | 0.470 | 18–30 | 0.711 | 10–14 | 0.948 | 7–9 |
| 5 | — | 120–170 | 0.226 | 40–60 | 0.409 | 20–32 | 0.618 | 12–16 | 0.803 | 9–10 |
| 6 | — | 110–160 | 0.356 | 20–40 | 0.686 | 10–20 | 1.042 | 4–9 | 1.395 | 4–6 |
| 7 | — | 110–150 | 0.301 | 20–34 | 0.594 | 10–16 | 0.852 | 7–9 | 1.10 | 6–8 |
| 8 | — | 110–160 | 0.099 | 50–75 | — | — | — | — | 0.334 | 20–50 |

As can be seen, even after only one hour of operation the solutions containing the oxalate/nitrate/peroxy combination (Nos. 6 and 7) produce dramatic results, both in terms of weight loss (which is indicative of efficiency, and is desirable if not due to dissolution from non-contact surfaces), and also in terms of surface smoothness. Further dramatic improvements are attained during the second and third hours, particularly with the phosphate-free solution (No. 6), ultimate refinement being produced by the end of the run.

Similar tests using solutions containing the same ingredients as No. 6, but in which the amount of peroxide is increased to 0.5 percent and 1.0 percent by volume of the 35 percent reagent (0.058 and 0.116 gram mole, respectively, of peroxy group per liter) produce inferior results. At the lower concentration, surface pitting is substantial and is in excess of that which would be considered commercially acceptable. At the higher level, excessive dissolution of metal from the non-contact areas of the parts occurs, and would be problematic as a practical matter. For example, on an open end wrench having an area on the gripping surfaces of about six square centimeters, a dimensional decrease (i.e., increase in the size of the opening) of about 0.013 millimeter per side is produced.

EXAMPLE TWO

Parallel runs are carried out using Solutions Nos. 1, 5 and 6, as defined in Table One, for vibratory finishing of hardened steel (RB-50) panels measuring about 5 by 10 centimeters and having surfaces of specular brightness. Four such panels are simultaneously loaded into a vibratory bowl having a capacity of about 28 liters, the bowl being substantially filled with ceramic media of angle-cut cylindrical form and containing about 20 percent of 325 grit aluminum oxide. About 0.5 liter of solution, heated to about 35° Centigrade, is used, and the unit is operated at an amplitude setting of 3 millimeters; in each case, the solution has a pH of about 1.5–1.6.

The times at which film formation is first observed, and at which the film appears continuous over the surface, are both noted. After one hour, the weight of the film developed, and the total weight loss per panel (average of three) are determined, and the condition of the surfaces of the panels is observed. The results are set forth in Table Three below, wherein times are expressed in minutes, weight loss is in grams, and film weight is in milligrams per square meter; in all instances, the surface is very lightly etched.

TABLE THREE

| | Solution Number | | |
|---|---|---|---|
| | 1 | 5 | 6 |
| First Film | 25 | 3 | 1 |
| Continuous Film | 45 | 6 | 4 |
| Film Weight | 0.065 | 0.08 | 0.17 |
| Weight Loss | 540 | 1,080 | 1,400 |

As will be appreciated, early film formation, the development of heavy deposits, and significant weight loss are all indicative of high effectiveness in the surface refinement operation. Consequently, the foregoing data, coupled with the observations of low etch and attack on non-contact surfaces, demonstrate the surprising results that are attained with the compositions and processes of the present invention.

Although oxalic acid, sodium nitrate and hydrogen peroxide will generally be the preferred ingredients, as a practical matter, substitutions of functionally equivalent compounds can of course be made. Indeed, in some instances the utilization of substitutes may be desirable.

More particularly, sodium oxalate, or a different water-soluble compound that will provide the oxalate radical, can be substituted for oxalic acid. Potassium nitrate can of course be used in place of sodium nitrate, and other alternative sources for the radicals will readily occur to those skilled in the art. As a matter of economics and practicality, the peroxy group will normally be furnished by hydrogen peroxide. When a single-package product is desired, however, the source of peroxide may be a water-soluble perborate, a percarbonate or a persulfate compound (e.g., the sodium derivatives). In view of the hydroscopic nature of such solid peroxy compounds, the incorporation of an anti-caking agent or a dessicant may be found to be beneficial.

As to the quantities of ingredients, the use of 0.125 to 0.65 gram mole per liter of the oxalate radical will generally be found to provide good processing speed without engendering undue attack upon the metal, albeit that the use of concentrations within the preferred range specified will, in most cases, provide the best results. The amount of the compound utilized to furnish the nitrate radical may vary within wide limits, it being necessary only that the minimum specified amount (i.e., 0.004 gram mole of the radical per liter) be present. The nitrate radical is believed to contribute both to the speed at which the metal surface is oxidized and also to the weight of the conversion coating produced. As noted, the radical may be present in a concentration as high as about 0.2 gram mole per liter or more, although in the normal case an amount in the range 0.05 to 0.11 gram mole per liter will afford optimal results.

Incorporation of the peroxy compound in an amount sufficient to provide the peroxy group in the specified concentration of 0.001 to 0.05 gram mole per liter is of utmost importance. The lower limit simply represents the amount that has been found to be adequately effective in combination with the other ingredients specified. Adherence to the upper limit, however, is believed to be essential to the attainment of the unexpected results achieved in accordance with the invention. Such amounts of peroxide enable substantial increases in reaction speed and conversion coating weights to be realized without producing significant pitting or excessive attack upon non-contact areas of the parts being treated.

As noted above, one percent by weight of 35 percent hydrogen peroxide (giving a concentration of the peroxide group in excess of about 0.1 gram mole per liter) increases reaction speed commensurately, but also causes excessive dissolution of the metal and makes the process difficult to control. Decreasing the concentration of the peroxy group by use of 0.5 percent of the peroxide reagent significantly moderates the dissolution of metal from the non-contact areas of the parts, and is accompanied by a reduction of only about 10 percent in the rate at which the oxide coating is produced; however, surface pitting occurs to an extent that is intolerable from the commercial standpoint.

Operating within the ranges of peroxy group concentration specified herein substantially avoids both the problem of excessive dissolution and also of surface pitting. Although it does so at some further sacrifice of reaction speed (i.e., the rate may be decreased by about 10 percent from that which is achieved utilizing a solution that is about 0.06 molar in peroxy), still the rate is substantially faster than that which would be realized utilizing the same formulation from which the peroxy compound has been omitted. More particularly, incorporating the peroxy and nitrate compounds in the quantities specified increases the rate of surface refinement by about 20 to 40 percent, as compared to that which is achieved using oxalic acid alone.

As will be appreciated by those skilled in the art, virtually any type of mass finishing equipment can be utilized in the practice of the instant process. Most generally, vibratory equipment will be used, but open tumbling barrel equipment, vented closed tumbling barrel equipment, and centrifugal finishing equipment can also be employed, if so desired. The equipment is operated in a normal manner, and abrasive or other physical media may or may not be added, depending upon the nature of the metal workpieces and the results desired. It should be understood that, as used herein, the term "mass of elements" encompasses both the metal surfaced objects that are to be treated, and also any physical mass finishing media that is employed. As is well known, typical media include quartz, granite, natural and synthetic aluminum oxides, silicon carbide and iron oxides, which may be held within a matrix, such as of porcelain, plastic, or the like. In the normal practice of the invention, a metal casting or forging will first be subjected to a coarse finishing operations, such as by grinding or belting to a 150 grit finish, and ferrous metal parts will normally te descaled and rinsed prior to treatment in accordance with the present process.

Thus, it can be seen that the present invention provides a novel solution, and a novel composition for producing the same, which is highly effective for the refinement of metal surfaces utilizing a chemical/mechanical finishing technique. The solution and composition effect surface refinement at increased rates while avoiding pitting of the surface and substantial dimensional decreases on non-contact areas; the coatings produced thereby are reformed continuously and at high rates and they are of increased thickness, enabling utilization of mass finishing apparatus at high energy levels and in turn maximizing production rates. The invention also provides a novel process for the refinement of metal surfaces utilizing such solutions, which achieves the desired improved surface and dimensional control at high production rates and under ambient conditions.

Having thus described the invention, what is claimed is:

1. An aqueous solution for use in the refinement of metal surfaces, comprising water, a water-soluble oxalate compound, a water-soluble nitrate compound, and a water-soluble peroxy compound, said solution containing a sufficient amount of said oxalate compound to provide about 0.125 to 0.65 gram mole per liter of the oxalate radical, a sufficient amount of said nitrate compound to provide at least about 0.004 gram mole per liter of the nitrate radical, and a sufficient amount of said peroxy compound to provide 0.001 to 0.05 gram mole per liter of the peroxy group.

2. The solution of claim 1 wherein said nitrate compound provides up to about 0.2 gram mole per liter of the nitrate radical.

3. The solution of claim 1 wherein said oxalate compound provides about 0.25 to 0.45 gram mole per liter of the oxalate radical, wherein said nitrate compound provides about 0.05 to 0.11 gram mole per liter of the nitrate radical, and wherein said peroxy compound provides about 0.01 to 0.03 gram mole per liter of the peroxy group.

4. The solution of claim 1 containing about 0.4 gram mole per liter of the oxalate radical, about 0.1 gram mole per liter of the nitrate radical, and 0.02 gram mole per liter of the peroxy group.

5. The solution of claim 1 additionally including an effective amount of a wetting agent.

6. The solution of claim 1 wherein said oxalate compound is oxalic acid, said nitrate compound is sodium nitrate, and said peroxy compound is hydrogen peroxide, said solution having a pH of about 1.5 to 3.0.

7. A composition for addition to water to provide an aqueous solution for use in the refinement of metal surfaces, comprising a water-soluble oxalate compound, a water-soluble nitrate compound, and a water-soluble peroxy compound, said composition including said compounds in quantities sufficient to provide, upon dilution with one liter of water, about 0.125 to 0.65 gram mole of the oxalate radical, at least about 0.004 gram mole of the nitrate radical, and 0.001 to 0.05 gram mole of the peroxy group.

8. The composition of claim 7 wherein said compounds are solid under ambient conditions, said composition being in the form of a substantially dry powder.

9. The composition of claim 8 wherein said oxalate compound is oxalic acid, said nitrate compound is sodium nitrate, and said peroxy compound is selected from the group consisting of sodium perborate, sodium percarbonate, sodium persulfate, ammonium persulfate, potassium perborate, and potassium persulfate.

10. In a process for the refinement of metal surfaces of objects, the steps comprising:

(a) providing an aqueous solution including water, a water-soluble oxalate compound, a water-soluble nitrate compound, and a water-soluble peroxy compound, said solution containing a sufficient amount of said oxalate compound to provide about 0.125 to 0.65 gram mole per liter of the oxalate radical, a sufficient amount of said nitrate compound to provide at least about 0.004 gram mole per liter of the nitrate radical, and a sufficient amount of said peroxy compound to provide 0.001 to 0.05 gram mole per liter of the peroxy group;

(b) introducing into the container of a mass finishing unit a mass of elements comprising of a quantity of objects with metal surfaces;

(c) wetting said mass of elements with said solution;

(d) rapidly agitating said mass of elements while maintaining said surfaces in a wetted condition with said solution, said agitation producing relative movement and contact among said elements; and (e) continuing said agitation step for a period sufficient to effect a significant reduction in roughness of said surfaces.

11. The process of claim 10 wherein said solution contains about 0.25 to 0.45 gram mole per liter of the oxalate radical, wherein said nitrate compound provides about 0.05 to 0.11 gram mole per liter of the nitrate radical, and wherein said peroxy compound provides about 0.01 to 0.03 gram mole per liter of the peroxy group.

12. The process of claim 10 wherein said mass of elements includes a quantity of mass finishing media.

13. The process of claim 10 wherein said metal surfaces have a finish of arithmetic average roughness in excess of about 30 at the time of introduction, and wherein said significant reduction in roughness produces an arithmetic roughness value of about 6.

14. The process of claim 13 wherein said period of said agitation step is about four hours or less.

15. The process of claim 14 wherein said agitation step produces continuous oxygenation of said solution.

16. The process of claim 15 wherein said solution is provided in an amount equal to about 15 to 25 percent of the volume of said mass finishing unit container.

17. The process of claim 10 wherein the metal of said object surfaces is selected from the group consisting of iron and alloys thereof.

* * * * *